US008431517B2

(12) United States Patent
Song

(10) Patent No.: US 8,431,517 B2
(45) Date of Patent: Apr. 30, 2013

(54) SURFACE CORROSION PROTECTION DETERGENT COMPOSITIONS CONTAINING POLYVALENT METAL COMPOUNDS AND HIGH LEVELS OF LOW FOAMING, NONIONIC SURFACTANTS

(75) Inventor: Brian Xiaoqing Song, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 598 days.

(21) Appl. No.: 11/227,366

(22) Filed: Sep. 15, 2005

(65) Prior Publication Data

US 2006/0069005 A1 Mar. 30, 2006

Related U.S. Application Data

(60) Provisional application No. 60/613,695, filed on Sep. 28, 2004.

(51) Int. Cl.

| | |
|---|---|
| ***C11D 17/04*** | (2006.01) |
| ***C11D 1/66*** | (2006.01) |
| ***C11D 3/12*** | (2006.01) |
| ***C11D 3/395*** | (2006.01) |

(52) U.S. Cl.
USPC ..... 510/220; 510/221; 510/224; 510/226; 510/228; 510/439

(58) Field of Classification Search ..... 510/220, 510/221, 224, 228, 226, 439
See application file for complete search history.

(56) References Cited

U.S. PATENT DOCUMENTS

| | | | | | |
|---|---|---|---|---|---|
| 3,976,588 | A | * | 8/1976 | McLaughlin | 34/283 |
| 4,001,133 | A | * | 1/1977 | Sorgenfrei et al. | 134/25.4 |
| 4,129,515 | A | * | 12/1978 | Foster | 510/340 |
| 4,443,270 | A | * | 4/1984 | Biard et al. | 134/25.2 |
| 4,917,812 | A | * | 4/1990 | Cilley | 510/227 |
| 4,933,101 | A | * | 6/1990 | Cilley et al. | 510/222 |
| 5,094,771 | A | * | 3/1992 | Ahmed et al. | 510/221 |
| 5,244,593 | A | * | 9/1993 | Roselle et al. | 510/127 |
| 5,415,801 | A | * | 5/1995 | Ofosu-Asante | 510/235 |
| 5,417,893 | A | * | 5/1995 | Ofosu-Asante | 510/235 |
| 5,474,710 | A | * | 12/1995 | Ofosu-Asanta et al. | 510/537 |
| 5,520,835 | A | * | 5/1996 | Sivik et al. | 510/220 |
| 5,624,892 | A | * | 4/1997 | Angevaare et al. | 510/223 |
| 5,783,539 | A | * | 7/1998 | Angevaare et al. | 510/223 |
| 6,133,227 | A | * | 10/2000 | Barnabas et al. | 510/530 |
| 6,262,003 | B1 | * | 7/2001 | Leonard et al. | 510/238 |
| 6,306,219 | B1 | * | 10/2001 | Ofosu-Asante et al. | 134/1 |
| 7,033,980 | B2 | * | 4/2006 | Waits et al. | 510/221 |
| 7,135,448 | B2 | * | 11/2006 | Lentsch et al. | 510/220 |
| 7,196,044 | B2 | * | 3/2007 | Smith et al. | 510/225 |
| 7,241,726 | B2 | * | 7/2007 | Song et al. | 510/220 |
| 7,271,138 | B2 | * | 9/2007 | Song et al. | 510/220 |
| 2003/0008798 | A1 | * | 1/2003 | Imaizumi et al. | 510/311 |
| 2004/0167048 | A1 | * | 8/2004 | Sunder et al. | 510/220 |
| 2004/0176264 | A1 | * | 9/2004 | Song et al. | 510/227 |
| 2004/0180807 | A1 | * | 9/2004 | Song et al. | 510/521 |
| 2005/0119154 | A1 | * | 6/2005 | Song et al. | 510/508 |
| 2005/0153868 | A1 | * | 7/2005 | Berger et al. | 510/508 |
| 2005/0202995 | A1 | * | 9/2005 | Waits et al. | 510/475 |
| 2005/0202996 | A1 | * | 9/2005 | Waits et al. | 510/475 |

FOREIGN PATENT DOCUMENTS

| | | | | |
|---|---|---|---|---|
| EP | 0 070 587 | A1 | | 1/1983 |
| EP | 0 383 480 | A1 | | 8/1990 |
| JP | 77209632 | A | * | 12/1982 |
| WO | WO 94/03574 | A1 | | 2/1994 |
| WO | WO 95/21234 | A1 | | 8/1995 |
| WO | WO 99/06466 | A1 | | 2/1999 |
| WO | WO 00/39259 | A1 | | 7/2000 |
| WO | WO 02/08371 | A2 | * | 1/2002 |
| WO | WO 02/068352 | A2 | | 9/2002 |
| WO | WO 03/104367 | A1 | | 12/2003 |
| WO | WO 2004/061068 | A1 | | 7/2004 |

OTHER PUBLICATIONS

U.S. Appl. No. 11/227,359, filed Sep. 15, 2005, Song.
U.S. Appl. No. 11/227,362, filed Sep. 15, 2005, Song, et al.
U.S. Appl. No. 11/227,365, filed Sep. 15, 2005, Song, et al.
U.S. Appl. No. 11/227,361, filed Sep. 15, 2005, Song, et al.

* cited by examiner

*Primary Examiner* — Lorna M Douyon
(74) *Attorney, Agent, or Firm* — Tiffany M. Zerby; Steven W. Miller

(57) ABSTRACT

Automatic dishwashing detergent compositions and compositions of matter, having polyvalent metal compounds and high levels of low-foaming, nonionic surfactants, are provided for protecting glassware from corrosion.

11 Claims, No Drawings

SURFACE CORROSION PROTECTION DETERGENT COMPOSITIONS CONTAINING POLYVALENT METAL COMPOUNDS AND HIGH LEVELS OF LOW FOAMING, NONIONIC SURFACTANTS

CROSS REFERENCE TO RELATED APPLICATION

This application claims the benefit of U.S. Provisional Application No. 60/613,695, filed Sep. 28, 2004.

FIELD OF THE INVENTION

The present invention relates to protecting glassware surfaces from corrosion using automatic dishwashing detergent compositions. More particularly, the present invention relates to automatic dishwashing detergent compositions and compositions of matter, having polyvalent metal compounds and high levels of low-foaming, nonionic surfactants.

BACKGROUND

Most consumers agree that the corrosion of glassware from use of detergent compositions in automatic dishwashing (ADW) is one of their most serious unmet needs. The current consensus amongst manufacturers is that the glassware corrosion problem occurs during the washing cycle of an automatic dishwashing appliance and may be the result of two separate phenomena acting-silica hydrolysis and metal ion leaching. Iridescence and clouding of glassware surfaces result when dissolved silica/silicate in combination with other silicate (added to prevent china and metal corrosion) deposit on glassware surfaces in high pH ADW environments. This phenomenon is known as silica hydrolysis. Glassware surface damage also results when chelate/metal ions on the glassware surface are removed during the wash cycle by the presence of a builder in the wash liquor. The removal of chelate/metal ions causes the surface to become less durable and less chemically resistant. This phenomenon is known as metal ion leaching. After several wash cycles in an ADW appliance, both phenomena can cause visible, unwanted damage to glassware in the form of cloudiness, abrasions, scratches, and streaks.

Although some manufacturers have tried to overcome these problems with the inclusion of corrosion protection agents in their ADW detergent compositions, the use of corrosion protection agents (such as, insoluble metal ions) may result in a number of manufacturing drawbacks. These include: (a) an increased cost of manufacture; (b) the need for higher salt level formulations; (c) the thinning of gel detergent compositions by metal ion interactions with thickener materials; and (d) the reduction of cleaning performance for certain stains (e.g. tea) generated by negative interactions of the metal ions with bleach during the wash cycle.

Although some ADW detergent compositions containing metal ions and low levels of nonionic surfactants are known, the levels of these nonionic surfactants have been limited to less than 8% by weight of the composition. This is due in part to the limited solubility of the nonionic surfactants in the wash solution. Therefore, the need continues for an ADW detergent composition that provides both glassware corrosion protection benefits and good cleaning benefits associated with higher levels of low-foaming nonionic surfactants, without unacceptable solubility negatives.

SUMMARY OF THE INVENTION

The present invention relates to ADW detergent compositions and compositions of matter, having polyvalent metal compounds and high levels of low-foaming, nonionic surfactants.

In accordance with one aspect, an ADW detergent composition comprises: (a) an effective amount of a polyvalent metal compound; (b) at least 8%, by weight, of a low-foaming nonionic surfactant with a cloud point of less than about 32° C.; and (c) optionally, at least one adjunct ingredient.

In accordance with another aspect, a composition of matter is provided. The composition of matter comprises a wash liquor comprising an automatic dishwashing detergent composition comprising: (a) at least 8%, by weight, of a low-foaming nonionic surfactant with a cloud point of less than about 32° C.; (b) an effective amount of a polyvalent metal compound; and (c) optionally, at least one adjunct ingredient. The wash liquor may comprise from about 0.0001 ppm to about 100 ppm of the polyvalent metal ion, by concentration.

DETAILED DESCRIPTION

The present invention relates to domestic, institutional, industrial, and/or commercial ADW detergent compositions and compositions of matter, having polyvalent metal compounds and high levels of low-foaming, nonionic surfactants.

It has surprisingly been found that ADW detergent compositions, which comprise high levels of low-foaming, nonionic surfactants with a cloud point of less than about 32° C. and certain polyvalent metal compounds, reduce glassware corrosion and provide effective cleaning performance without the solubility negatives that are generally associated with ADW detergent compositions that comprise nonionic surfactants at levels 8% or greater, by weight of the composition.

Liquid and gel ADW detergent compositions that comprise an effective amount of a polyvalent metal compound and at least 8%, by weight, of a low-foaming, nonionic surfactant with a cloud point of less than about 32° C. may also benefit by dispersing the polyvalent metal compound particles in water prior to formulating the liquid or gel ADW detergent compositions.

An "effective amount" herein is meant an amount that is sufficient to provide a improvement in corrosion protection over at least about fifty (50) cycles, when using the ADW detergent composition described herein in a typical U.S. ADW appliance (i.e. such as, a GE 9000) according to the test method for measuring glassware surface corrosion protection described herein.

By "high level of low-foaming, nonionic surfactant" herein is meant an ADW detergent composition comprising at least 8% by weight of the composition, of a low-foaming, nonionic surfactant with a cloud point of less than about 32° C. By "low level of low-foaming, nonionic surfactant" herein is meant an ADW detergent composition comprising less than 8%, by weight of the composition, of a low-foaming, nonionic surfactant with a cloud point of less than about 32° C., as are found in conventional ADW detergent compositions.

By "water-soluble salts" herein is meant a polyvalent metal salt with a solubility of greater than or equal to about 1% in water at ambient temperature. By "slightly water-insoluble salts" herein is meant a polyvalent metal salt with a solubility of less than about 1% in water at ambient temperature. By "water-insoluble salts" herein is meant a polyvalent metal salt with a solubility of less than about 0.1% in water at ambient temperature.

Polyvalent Metal Compounds

Any suitable polyvalent metal compound may be used in any suitable amount or form. Suitable polyvalent metal compounds include, but are not limited to: polyvalent metal salts, oxides, hydroxides, and mixtures thereof. Suitable polyvalent metals include, but are not limited to: Groups IIA, IIIA, IVA, VA, VA, VIIA, IIB, IIIB, IVB, VB and VIII of the Periodic Table of the Elements. For example, suitable polyvalent metals may include Al, Mg, Co, Ti, Zr, V, Nb, Mn, Fe, Ni, Cd, Sn, Sb, Bi, and Zn. These polyvalent metals may be used in any suitable oxidation state. Suitable oxidation states are those that are stable in the ADW detergent compositions described herein.

Any suitable polyvalent metal salt may be used in any suitable amount or form. Suitable salts include but are not limited to: organic salts, inorganic salts, and mixtures thereof. For example, suitable polyvalent metal may include: water-soluble metal salts, slightly water-soluble metal salts, water-insoluble metal salts, slightly water-insoluble metal salts, and mixtures thereof.

Suitable water-soluble aluminum salts may include, but are not limited to: aluminum acetate, aluminum ammonium sulfate, aluminum chlorate, aluminum chloride, aluminum chlorohydrate, aluminum diformate, aluminum fluoride, aluminum formoacetate, aluminum lactate, aluminum nitrate, aluminum potassium sulfate, aluminum sodium sulfate, aluminum sulfate, aluminum tartrate, aluminum triformate, and mixtures thereof. Suitable water-insoluble aluminum salts may include, but are not limited to: aluminum silicates, aluminum salts of fatty acids (e.g., aluminum stearate and aluminum laurate), aluminum metaphosphate, aluminum monostearate, aluminum oleate, aluminum oxylate, aluminum oxides and hydroxides (e.g., activated alumina and aluminum hydroxide gel), aluminum palmitate, aluminum phosphate, aluminum resinate, aluminum salicylate, aluminum stearate, and mixtures thereof.

Suitable water-soluble magnesium salts may include, but are not limited to: magnesium acetate, magnesium acetylacetonate, magnesium ammonium phosphate, magnesium benzoate, magnesium biophosphate, magnesium borate, magnesium borocitrate, magnesium bromate, magnesium bromide, magnesium calcium chloride, magnesium chlorate, magnesium chloride, magnesium citrate, magnesium fluosilicate, magnesium formate, magnesium gluconate, magnesium glycerophosphate, magnesium lauryl sulfate, magnesium nitrate, magnesium phosphate monobasic, magnesium salicylate, magnesium stannate, magnesium stannide, magnesium sulfate, magnesium sulfite, and mixtures thereof. Suitable water-insoluble magnesium salts may include, but are not limited to: magnesium aluminate, magnesium fluoride, magnesium oleate, magnesium perborate, magnesium phosphate dibasic, magnesium phosphate tribasic, magnesium pyrophosphate, magnesium silicate, magnesium trisilicate, magnesium sulfide, magnesium tripolyphosphate, and mixtures thereof.

Suitable water-soluble zinc salts may include, but are not limited to: zinc acetate, zinc benzoate, zinc borate, zinc bromate, zinc bromide, zinc chlorate, zinc chloride, zinc ethysulfate, zinc fluorosilicate, zinc formate, zinc gluconate, zinc hydrosulfite, zinc lactate, zinc linoleate, zinc malate, zinc nitrate, zinc perborate, zinc salicylate, zinc sulfate, zinc sulfamate, zinc tartrate, and mixtures thereof. Suitable water-insoluble zinc salts may include, but are not limited to: zinc bacitracin, zinc carbonate, zinc basic carbonate or basic zinc carbonate, hydrozincite, zinc laurate, zinc phosphate, zinc tripolyphosphate, sodium zinc tripolyphosphate, zinc silicate, zinc stearate, zinc sulfide, zinc sulfite, and mixtures thereof.

Any suitable polyvalent metal oxide and/or hydroxide may be used in any suitable amount or form. Suitable polyvalent metal oxides may include, but are not limited to: aluminum oxide, magnesium oxide, and zinc oxide. Suitable polyvalent metal hydroxides may include, but are not limited to: aluminum hydroxide, magnesium hydroxide, and zinc hydroxide.

In certain non-limiting embodiments, polyvalent metal compounds may be used in their water-insoluble form. The presence of the polyvalent metal compounds in an essentially insoluble but dispersed form may inhibit the growth of large precipitates from within ADW detergent product and/or wash liquor solution. Not to be bound by theory, it is believed that because the water-insoluble polyvalent metal compound is in a form in product that is essentially insoluble, the amount of precipitate, which will form in the wash liquor of the dishwashing process, is greatly reduced. Although the insoluble polyvalent metal compound will dissolve only to a limited extent in the wash liquor, the dissolved metal ions are in sufficient concentration to impart the desired glasscare benefit to treated dishware. Hence, the chemical reaction of dissolved species that produce precipitants in the dishwashing process is controlled. Thus, use of water-insoluble polyvalent metal compounds allows for control of the release of reactive metal species in the wash liquor, as well as, the control of unwanted precipitants.

In certain non-limiting embodiments, the amount of polyvalent metal compound may be provided in a range of from about 0.01% to about 60%, from about 0.02% to about 50%, from about 0.05% to about 40%, from about 0.05% to about 30%, from about 0.05% to about 20%, from about 0.05% to about 10%, and alternatively, from about 0.1% to about 5%, by weight, of the composition.

Particle Size

The polyvalent metal compound in the ADW detergent compositions prepared herein may comprise particles having any suitable average particle size. Suitable average particle sizes include, but not limited to: a range of from about 1 nm to about 150 microns; from about 10 nm to about 100 microns; from about 10 nm to about 50 microns; from about 10 nm to about 30 microns; from about 10 nm to about 20 microns; from about 10 nm to about 10 microns; and alternatively, from about 100 nm to about 10 microns. In one non-limiting embodiment, the polyvalent metal compound particles may have an average particle size of less than about 15 microns, or less than about 10 microns, and alternatively less than about 5 microns.

Particle Size Distribution

The ADW detergent compositions may comprise particles of polyvalent metal compounds having any suitable particle size distribution. Suitable particle size distributions include, but are not limited to: a range from about 0.1 nm to about 250 microns; from about 1 nm to about 150 microns; from about 1 nm to about 100 microns; from about 1 nm to about 50 microns; from about 1 nm to about 30 microns; from about 1 nm to about 20 microns; from about 1 nm to about 10 microns; from about 1 nm to about 1 micron; from about 1 nm to about 500 nm; from about 1 nm to about 100 nm; from about 1 nm to about 50 nm; from about 1 nm to about 30 nm; from about 1 nm to about 20 nm; and alternatively, from about 1 nm to about 10 nm.

Low Foaming, Non-Ionic Surfactants

The ADW detergent compositions described herein may comprise any suitable low-foaming, nonionic surfactant (LFNI) in any suitable amount or form. When compared to typical detergent compositions comprising nil LFNI surfactants, the ADW detergent compositions described herein exhibit good sudsing control in the test methods described herein. LFNI surfactants are most typically used to confer improved water-sheeting action (especially on glassware) to the ADW product. LFNI surfactants generally are well known, being described in more detail in Kirk Othmer's Encyclopedia of Chemical Technology, 3rd Ed., Vol. 22, pp. 360-379, "Surfactants and Detersive Systems".

While a wide range of LFNI surfactants may be selected from for purposes of providing the surfactant systems useful in the ADW detergent compositions and products described herein, it is necessary that at least one low cloud point LFNI surfactant be present in the ADW detergent composition. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362, hereinbefore).

A "low cloud point" LFNI surfactant may be defined as a nonionic surfactant having a cloud point of less than about 32° C. "Low cloud point" LFNI surfactants may, for instance, have a cloud point of less than about 30° C., less than about 28° C., less than about 26° C., less than about 24° C., less than about 22° C., less than about 20° C., less than about 18° C., less than about 16° C., less than about 14° C., less than about 12° C., less than about 10° C., less than about 8° C., less than about 6° C., less than about 4° C., less than about 2° C., and alternatively, less than about 0° C.

Typical low cloud point LFNI surfactants include nonionic alkoxylated surfactants; especially ethoxylates derived from primary alcohol, and polyoxypropylene/polyoxyethylene/polyoxypropylene (PO/EO/PO) reverse block polymers. Such low cloud point nonionic surfactants also include, for example, ethoxylated-propoxylated alcohol (e.g., Olin Corporation's POLY-TERGENT® SLF-18) and epoxy-capped poly(oxyalkylated) alcohols (e.g., Olin Corporation's POLY-TERGENT® SLF-18B series of nonionics, as described, for example, in WO 94/22800, published Oct. 13, 1994 by Olin Corporation). Other suitable nonionic surfactants can be prepared by using the processes described in U.S. Pat. No. 4,223,163 issued Sep. 16, 1980, Builloty.

Low cloud point LFNI surfactants may additionally comprise a polyoxyethylene, polyoxypropylene block polymeric compound. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC® by the BASF-Wyandotte Corp., Wyandotte, Mich., are also suitable in ADW detergent compositions described herein. Non-limiting examples include REVERSED PLURONIC® 25R2 and TETRONIC® 702. Such surfactants are typically useful herein as low cloud point nonionic surfactants.

The low cloud point LFNI surfactant, described herein, may further have a hydrophile-lipophile balance ("HLB"; see Kirk Othmer hereinbefore) value within the range of from about 1 to about 10; and alternatively, from about 3 to about 8.

A "high cloud point" nonionic surfactant may be defined as a nonionic surfactant or surfactant system ingredient having a cloud point of greater than 40° C. "High cloud point" nonionic surfactants may, for instance, have a cloud point greater than about 50° C., and alternatively greater than about 60° C. Optionally, the ADW detergent compositions described herein may further comprise a high cloud point LFNI surfactant. Any suitable high cloud point nonionic surfactant may be used herein in any suitable amount or form.

The high cloud point LFNI surfactant system may comprise an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis. These high cloud point LFNI surfactants may have a hydrophile-lipophile balance ("HLB"; see Kirk Othmer hereinbefore) value within the range of from about 9 to about 15, alternatively from about 11 to about 15. Such high cloud point nonionic surfactants may include, for example, TERGITOL® 15S9 (supplied by Union Carbide), RHODASURF® TMD 8.5 (supplied by Rhone Poulenc), and NEODOL®91-8 (supplied by Shell).

Suitable high cloud point LFNI surfactants may also be derived from a straight or branched chain or secondary fatty alcohol containing from about 6 to about 20 carbon atoms ($C_6$-$C_{20}$ alcohol), including secondary alcohols and branched chain primary alcohols. Preferably, high cloud point nonionic surfactants are branched or secondary alcohol ethoxylates, more preferably mixed $C_{9/11}$ or $C_{11/15}$ branched alcohol ethoxylates, condensed with an average of from about 6 to about 15 moles, from about 6 to about 12 moles, and alternatively, from about 6 to about 9 moles of ethylene oxide per mole of alcohol. The ethoxylated nonionic surfactant so derived may have a narrow ethoxylate distribution relative to the average.

The LFNI surfactant may also encompass suitable polymeric materials in any suitable amount or form. Suitable polymeric materials may include, but are not limited to: silicone polymers, non-silicone polymers, phosphate polymers, or non-phosphate polymers. These polymeric materials are known to defoam food soils commonly encountered in ADW processes. LFNI surfactants can also optionally contain propylene oxide in an amount up to about 15% by weight.

In certain embodiments, the ADW detergent composition may comprise an LFNI surfactant in an amount from 8% to about 60%, from 8% to about 50%, from 8% to about 40%, from 8% to about 30%, from 8% to about 20%, and alternatively, from 8% to about 10% by weight of the composition.

pH

The ADW detergent composition herein may have any suitable pH. A suitable pH for at least some non-limiting embodiments may fall anywhere within the range of from about 7 to about 12, from about 8 to about 12, from about 9 to about 11.5, and alternatively from about 9 to about 11 as measured by a 1% aqueous solution. For example, certain embodiments of the ADW detergent composition have a pH of greater than or equal to about 7, greater than or equal to about 8, greater than or equal to about 9, greater than or equal to about 10, greater than or equal to about 11, and alternatively, equal to about 12, as measured by a 1% aqueous solution.

Optional Adjunct Ingredients

Any suitable adjunct ingredient in any suitable amount may be used in the ADW detergent composition. Suitable adjunct ingredients as described herein may be substantially sodium ion-free. Suitable adjunct ingredients may include, but are not limited to: co-surfactants; suds suppressors; builders; enzymes; bleaching systems; dispersant polymers; carrier medium; and mixtures thereof.

Other suitable adjunct ingredients may include, but are not limited to: enzyme stabilizers, such as calcium ion, boric acid, propylene glycol, short chain carboxylic acids, boronic acids, and mixtures thereof; chelating agents, such as, alkali metal ethane 1-hydroxy diphosphonates (HEDP), alkylene poly (alkylene phosphonate), as well as, amino phosphonate compounds, including amino aminotri(methylene phosphonic acid) (ATMP), nitrilo trimethylene phosphonates (NTP), ethylene diamine tetra methylene phosphonates, and diethylene triamine penta methylene phosphonates (DTPMP); alkalinity sources; pH buffering agents, such as, amino acids, tris(hydroxymethyl)amino methane (TRIS), 2-amino-2-ethyl-1,3-propanediol, 2-amino-2-methyl-propanol, 2-amino-2-methyl-1,3-propanol, potassium glutamate, N-methyl diethanolamide, 1,3-diamino-propanol N,N'-tetra-methyl-1,3-diamino-2-propanol, N,N-bis(2-hydroxyethyl)glycine (bicine), N-tris (hydroxymethyl)methyl glycine (tricine), potassium carbonate, potassium polyphosphate, and organic diamines; water softening agents; secondary solubility modifiers; soil release polymers; hydrotropes; binders; antibacterial actives, such as citric acid, benzoic acid, benzophenone, thymol, eugenol, menthol, geraniol, vertenone, eucalyptol, pinocarvone, cedrol, anethol, carvacrol, hinokitiol, berberine, ferulic acid, cinnamic acid, methyl salicylic acid, methyl salicylate, terpineol, limonene, and halide-containing compounds; detergent fillers, such as potassium sulfate; abrasives, such as, quartz, pumice, pumicite, titanium dioxide, silica sand, calcium carbonate, zirconium silicate, diatomaceous earth, whiting, and feldspar; anti-redeposition agents, such as organic phosphate; anti-oxidants; metal ion sequestrants; anti-tarnish agents, such as benzotriazole; anti-corrosion agents, such as, aluminum-, magnesium-, zinc-containing materials (e.g. hydrozincite and zinc oxide); processing aids; plasticizers, such as, propylene glycol, and glycerine; thickening agents, such as cross-linked polycarboxylate polymers with a weight-average molecular weight of at least about 500,000 (e.g. CARBOPOL® 980 from B.F. Goodrich), naturally occurring or synthetic clays, starches, celluloses, alginates, and natural gums, (e.g. xanthum gum); aesthetic enhancing agents, such as dyes, colorants, pigments, speckles, perfume, and oils; preservatives; and mixtures thereof. Suitable adjunct ingredients may contain low levels of sodium ions by way of impurities or contamination. In certain non-limiting embodiments, adjunct ingredients may be added during any step in the process in an amount from about 0.0001% to about 91.99%, by weight of the composition.

Adjunct ingredients suitable for use are disclosed, for example, in U.S. Pat. Nos. 3,128,287; 3,159,581; 3,213,030; 3,308,067; 3,400,148; 3,422,021; 3,422,137; 3,629,121; 3,635,830; 3,835,163; 3,923,679;3,929,678; 3,985,669; 4,101,457; 4,102,903; 4,120,874; 4,141,841; 4,144,226; 4,158,635; 4,223,163; 4,228,042; 4,239,660; 4,246,612; 4,259,217; 4,260,529; 4,530,766; 4,566,984; 4,605,509; 4,663,071; 4,663,071; 4,810,410; 5,084,535; 5,114,611; 5,227,084; 5,559,089; 5,691,292; 5,698,046; 5,705,464; 5,798,326; 5,804,542; 5,962,386; 5,967,157; 5,972,040; 6,020,294; 6,113,655; 6,119,705; 6,143,707; 6,326,341; 6,326,341; 6,593,287; and 6,602,837; European Patent Nos.: 0,066,915; 0,200,263; 0,332,294; 0,414,549; 0,482,807; and 0,705,324; PCT Pub. Nos.: WO 93/08876; and WO 93/08874.

Co-Surfactants

Any suitable co-surfactant in any suitable amount or form may be used herein. Suitable co-surfactants include anionic surfactants, cationic surfactants, nonionic surfactants, amphoteric surfactants, ampholytic surfactants, zwitterionic surfactants, and mixtures thereof. For example, a co-surfactant may be used in a surfactant system or mixed surfactant system comprising two or more distinct surfactants (such as, a charged co-surfactant selected from nonionic surfactants, zwitterionic surfactants, anionic surfactants, and mixtures thereof). The zwitterionic surfactant may be chosen from the group consisting of $C_8$ to $C_{18}$ (alternatively, $C_{12}$ to $C_{18}$) amine oxides and sulfo- and hydroxy-betaines, such as N-alkyl-N, N-dimethylammino-1-propane sulfonate where the alkyl group can be $C_8$ to $C_{18}$, alternatively $C_{10}$ to $C_{14}$. The anionic surfactant may be chosen from alkylethoxycarboxylates, alkylethoxysulfates, with the degree of ethoxylation greater than 3 (alternatively from about 4 to about 10, or from about 6 to about 8), and chain length in the range of $C_8$ to $C_{16}$, alternatively in the range of $C_{11}$ to $C_{15}$.

Additionally, branched alkylcarboxylates have been found to be useful when the branch occurs in the middle and the average total chain length may be 10 to 18, alternatively 12-16 with the side branch 2-4 carbons in length. An example is 2-butyloctanoic acid. The anionic surfactant may be typically of a type having good solubility in the presence of calcium. Such anionic surfactants are further illustrated by sulfobetaines, alkyl(polyethoxy)sulfates (AES), alkyl (polyethoxy) carboxylates (AEC), and short-chained $C_6$-$C_{10}$ alkyl sulfates and sulfonates.

Co-surfactants suitable for use are disclosed, for example, in U.S. Pat. Nos. 3,929,678; 4,223,163; 4,228,042; 4,239,660; 4,259,217; 4,260,529; and 6,326,341; EP Pat. No. 0414 549, EP Pat. No. 0,200,263, PCT Pub. No. WO 93/08876 and PCT Pub. No. WO 93/08874.

Suds Suppressor

Any suitable suds suppressor in any suitable amount or form may be used herein. Suds suppressors suitable for use may be low-foaming and include low cloud point nonionic surfactants (as discussed above) and mixtures of higher foaming surfactants with low cloud point nonionic surfactants which act as suds suppressors therein (see EP Pat. No. 0705324, U.S. Pat. Nos. 6,593,287, and 6,326,341). In certain embodiments, one or more suds suppressors may be present in an amount from about 0% to about 30% by weight, or about 0.2% to about 30% by weight, or from about 0.5% to about 10%, and alternatively, from about 1% to about 5% by weight of composition.

Builders

Any suitable builder in any suitable amount or form may be used herein. Suitable builders may include, but are not limited to: citrates, phosphates (such as sodium tripolyphosphate (STPP), potassium tripolyphosphate (KTPP), mixed sodium potassium tripolyphosphate (SKTP), sodium pyrophosphate or potassium pyrophosphate or mixed sodium potassium pyrophosphate (SKPP), aluminosilicates, silicates, polycarboxylates, fatty acids, such as ethylene-diamine tetraacetate, metal ion sequestrants such as aminopolyphosphonates, ethylenediamine tetramethylene phosphonic acid, and diethylene triamine pentamethylene-phosphonic acid, and mixtures thereof.

Examples of other suitable builders are disclosed in the following patents and publications: U.S. Pat. Nos. 3,128,287; 3,159,581; 3,213,030; 3,308,067; 3,400,148; 3,422,021; 3,422,137; 3,635,830; 3,835,163; 3,923,679; 3,985,669; 4,102,903; 4,120,874; 4,144,226; 4,158,635; 4,566,984; 4,605,509; 4,663,071; and 4,663,071; German Patent Application No. 2,321,001 published on Nov. 15, 1973; European Pat. No. 0,200,263; Kirk Othmer, 3rd Edition, Vol. 17, pp. 426-472 and in "Advanced Inorganic Chemistry" by Cotton and Wilkinson, pp. 394-400 (John Wiley and Sons, Inc.; 1972).

Enzyme

Any suitable enzyme and/or enzyme stabilizing system in any suitable amount or form may be used herein. Enzymes suitable for use include, but are not limited to: proteases, amylases, lipases, cellulases, peroxidases, and mixtures thereof. Amylases and/or proteases are commercially available with improved bleach compatibility.

Suitable proteolytic enzymes include, but are not limited to: trypsin, subtilisin, chymotrypsin and elastase-type proteases. Suitable for use herein are subtilisin-type proteolytic enzymes. Particularly preferred is bacterial serine proteolytic enzyme obtained from *Bacillus subtilis* and/or *Bacillus licheniformis*. Suitable proteolytic enzymes also include Novo Industri A/S ALCALASE®, ESPERASE®, SAVINASE® (Copenhagen, Denmark), Gist-brocades' MAXATASE®, MAXACAL® and MAXAPEM® 15 (protein engineered MAXACAL®) (Delft, Netherlands), and subtilisin BPN and BPN'(preferred), which are commercially available. Suitable proteolytic enzymes may include also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International), which is called "Protease A" herein (same as BPN'). In particular see columns 2 and 3 of U.S. Pat. No. 5,030,378 for a complete description, including amino sequence, of Protease A and its variants. Other proteases are sold under the tradenames: PRIMASE®, DURAZYM®, OPTICLEAN® and OPTIMASE®. In one non-limiting embodiment, a suitable proteolytic enzyme may be selected from the group consisting of ALCALASE® (Novo Industri A/S), BPN', Protease A and Protease B (Genencor), and mixtures thereof.

In practical terms, the ADW detergent composition may comprise an amount up to about 5 mg, more typically about 0.01 mg to about 3 mg by weight, of active enzyme per gram of the composition. Protease enzymes may be provided as a commercial preparation at levels sufficient to provide from 0.005 to 0.1 Anson units (AU) of activity per gram of composition, or 0.01%-1% by weight of the enzyme preparation. For ADW purposes, it may be desirable to increase the active enzyme content in order to reduce the total amount of non-catalytically active materials delivered and thereby improve anti-spotting/anti-filming results. Examples of suitable enzymes are disclosed in the following patents and publications: U.S. Pat. Nos. 4,101,457; 5,559,089; 5,691,292; 5,698,046; 5,705,464; 5,798,326; 5,804,542; 5,962,386; 5,967,157; 5,972,040; 6,020,294; 6,113,655; 6,119,705; 6,143,707; and 6,602,837.

In certain embodiments, enzyme-containing ADW detergent compositions, especially liquids, liquigels, and gels, may comprise from about 0.0001% to about 10%, or from about 0.005% to 8%, or from about 0.01% to about 6%, by weight of an enzyme stabilizing system. The enzyme stabilizing system can include any stabilizing agent that is compatible with the detersive enzyme. Suitable enzyme stabilizing agents can include, but are not limited to: calcium ions, boric acid, glycerine, propylene glycol, short chain carboxylic acid, boronic acid, and mixtures thereof.

Bleaching System

Any suitable bleaching system comprising any suitable bleaching agent in any suitable amount or form may be used herein. Suitable bleaching agents include, but are not limited to: halogenated bleaches and oxygen bleaches.

Any suitable oxygen bleach may be used herein. Suitable oxygen bleaches can be any convenient conventional oxygen bleach, including hydrogen peroxide. For example, perborate, e.g., sodium perborate (any hydrate, e.g. mono- or tetrahydrate), potassium perborate, sodium percarbonate, potassium percarbonate, sodium peroxyhydrate, potassium peroxyhydrate, sodium pyrophosphate peroxyhydrate, potassium pyrophosphate peroxyhydrate, sodium peroxide, potassium peroxide, or urea peroxyhydrate can be used herein. Organic peroxy compounds can also be used as oxygen bleaches. Examples of these are benzoyl peroxide and the diacyl peroxides. Mixtures of any convenient oxygen bleaching sources can also be used.

Any suitable halogenated bleach may be used herein. Suitable halogenated bleaches may include chlorine bleaches. Suitable chlorine bleaches can be any convenient conventional chlorine bleach. Such compounds are often divided in to two categories namely, inorganic chlorine bleaches and organic chlorine bleaches. Examples of the former are sodium hypochlorite, calcium hypochlorite, potassium hypochlorite, magnesium hypochlorite and chlorinated trisodium phosphate dodecahydrate. Examples of the latter are potassium dichloroisocyanurate, sodium dichloroisocyanurate, 1,3-dichloro-5,5-dimethlhydantoin, N-chlorosulfamide, chloramine T, dichloramine T, chloramine B, dichloramine T, N,N'-dichlorobenzoylene urea, paratoluene sulfondichoroamide, trichloromethylamine, N-chlorosuccinimide, N,N'-dichloroazodicarbonamide, N-chloroacetyl urea, N,N'-dichlorobiuret and chlorinated dicyandamide.

The bleaching system may also comprise transition metal-containing bleach catalysts, bleach activators, and mixtures thereof. Bleach catalysts suitable for use include, but are not limited to: the manganese triazacyclononane and related complexes (see U.S. Pat. No. 4,246,612, U.S. Pat. No. 5,227,084); Co, Cu, Mn and Fe bispyridylamine and related complexes (see U.S. Pat. No. 5,114,611); and pentamine acetate cobalt (III) and related complexes (see U.S. Pat. No. 4,810,410) at levels from 0% to about 10.0%, by weight; and alternatively, from about 0.0001% to about 1.0%.

Typical bleach activators suitable for use include, but are not limited to: peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP Pat. No. 0170386); and benzoxazin peroxyacid precursors (EP Pat. No. 0332294 and EP Pat. No. 0482807) at levels from 0% to about 10.0%, by weight; or from about 0.1% to about 1.0%.

Other bleach activators include substituted benzoyl caprolactam bleach activators. The substituted benzoyl caprolactams have the formula:

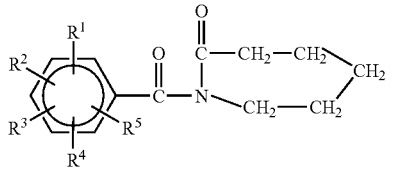

wherein $R^1$, $R^2$, $R^3$, $R^4$, and $R^5$ contain from 1 to 12 carbon atoms, or from 1 to 6 carbon atoms and are selected from the group consisting of H, halogen, alkyl, alkoxy, alkoxyaryl, alkaryl, alkaryloxy, and members having the structure:

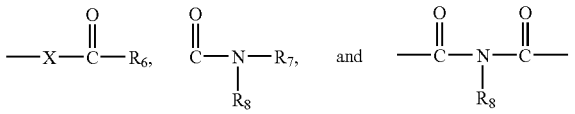

wherein $R_6$ is selected from the group consisting of H, alkyl, alkaryl, alkoxy, alkoxyaryl, alkaryloxy, and aminoalkyl; X is O, NH, or $NR_7$, wherein $R_7$ is H or a $C_1$-$C_4$ alkyl group; and $R_8$ is an alkyl, cycloalkyl, or aryl group containing from 3 to 11 carbon atoms; provided that at least one R substituent is not H. The $R^1$, $R^2$, $R^3$, and $R^4$ are H and $R^5$ may be selected from the group consisting of methyl, methoxy, ethyl, ethoxy, propyl, propoxy, isopropyl, isopropoxy, butyl, tert-butyl, butoxy, tert-butoxy, pentyl, pentoxy, hexyl, hexoxy, Cl, and $NO_3$. Alternatively, $R^1$, $R^2$, $R^3$ are H, and $R^4$ and $R^5$ may be selected from the group consisting of methyl, methoxy, and Cl.

In certain embodiments, the bleaching agent, bleach catalyst, and/or bleach activator may be encapsulated with any suitable encapsulant that is compatible with the aqueous ADW detergent composition and any bleach-sensitive adjunct ingredient (e.g. enzymes). For example, sulfate/carbonate coatings may be provided to control the rate of release as disclosed in UK Pat. No. GB 1466799.

Examples of suitable bleaching agents and bleaching systems may be disclosed in the following publications: GB-A-836988, GB-A-855735, GB-A-864798, GB-A-1147871, GB-A-1586789, GB-A-1246338, and GB-A-2143231. In other embodiments, the bleaching agent or bleaching system may be present in an amount from about 0% to about 30% by weight, or about 1% to about 15% by weight, or from about 1% to about 10% by weight, and alternatively from about 2% to about 6% by weight of composition.

Dispersant Polymer

Any suitable dispersant polymer in any suitable amount may be used herein. Unsaturated monomeric acids that can be polymerized to form suitable dispersant polymers (e.g. homopolymers, copolymers, or terpolymers) include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. may be suitable provided that such segments do not constitute more than about 50% by weight of the dispersant polymer. Suitable dispersant polymers include, but are not limited to those disclosed in U.S. Pat. Nos. 3,308,067; 3,308,067; and 4,379,080.

Substantially non-neutralized forms of the polymer may also be used in the ADW detergent compositions. The weight-average molecular weight of the polymer can vary over a wide range, for instance from about 1000 to about 500,000, alternatively from about 1000 to about 250,000. Copolymers of acrylamide and acrylate having a weight-average molecular weight of from about 3,000 to about 100,000, or from about 4,000 to about 20,000, and an acrylamide content of less than about 50%, and alternatively, less than about 20%, by weight of the dispersant polymer can also be used. The dispersant polymer may have a weight-average molecular weight of from about 4,000 to about 20,000 and an acrylamide content of from about 0% to about 15%, by weight of the polymer. Suitable modified polyacrylate copolymers include, but are not limited to the low molecular weight copolymers of unsaturated aliphatic carboxylic acids disclosed in U.S. Pat. Nos. 4,530,766, and 5,084,535; and European Patent No. 0,066,915.

Other suitable dispersant polymers include polyethylene glycols and polypropylene glycols having a molecular weight of from about 950 to about 30,000, which can be obtained from the Dow Chemical Company of Midland, Mich. Such compounds for example, having a melting point within the range of from about 30° C. to about 100° C. can be obtained at weight-average molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene and polypropylene glycol. The polyethylene, polypropylene, and mixed glycols are referred to using the formula:

$$HO(CH_2CH_2O)_m(CH_2CH(CH_3)O)_n(CH(CH_3)CH_2O)_oH$$

wherein m, n, and o are integers satisfying the molecular weight and temperature requirements given above.

Suitable dispersant polymers also include the polyaspartate, carboxylated polysaccharides, described in U.S. Pat. No. 3,723,322; the dextrin esters of polycarboxylic acids disclosed in U.S. Pat. No. 3,929,107.

In certain embodiments, a dispersant polymer may be present in an amount in the range from about 0.01% to about 25%, or from about 0.1% to about 20%, and alternatively, from about 0.1% to about 7% by weight of the composition.

Carrier Medium

Any suitable carrier medium in any suitable amount in any suitable form may be used herein. Suitable carrier mediums include both liquids and solids depending on the form of the ADW detergent composition desired. A solid carrier medium may be used in dry powders, granules, tablets, encapsulated products, and combinations thereof. Suitable solid carrier mediums include, but are not limited to carrier mediums that are non-active solids at ambient temperature. For example, any suitable organic polymer, such as polyethylene glycol (PEG), may be used herein. In certain embodiments, the solid carrier medium may be present in an amount in the range from about 0.01% to about 20%, or from about 0.01% to about 10%, and alternatively, from about 0.01% to about 5% by weight of the composition.

Suitable liquid carrier mediums for liquid and gel ADW detergent compositions include, but are not limited to: water (distilled, deionized, or tap water), solvents, and mixtures thereof. The liquid carrier medium may be present in an amount in the range from about 1% to about 91.99%, or from about 20% to about 80%, and alternatively, from about 30% to about 70% by weight of the composition. The liquid carrier medium, however, may also contain materials other than water which are liquid, or which dissolve in the liquid carrier medium at room temperature, and which may also serve some other function besides that of a carrier. These materials include, but are not limited to: dispersants, hydrotropes, and mixtures thereof and may be present in any suitable amount, such as in an amount from about 0.001% to about 91.99% by weight of the composition. In certain non-limiting embodiments, the dispersant and/or hydrotrope may be present in an amount from about 0.001% to about 10% by weight of the composition.

Product Form

Any suitable product form may be used herein. Suitable product forms include, but are not limited to: solids, granules, powders, liquids, liquigels, gels, pastes, creams, and combinations thereof. Any suitable dispensing means may be used herein. Suitable dispensing means include dispensing baskets or cups, bottles (e.g. pump-assisted bottles, squeeze bottles, etc.), mechanical pumps, multi-compartment bottles, paste dispensers, capsules, tablets, multi-phase tablets, coated tablets, single- and/or multi-compartment water-soluble pouches, single- and/or multi-gel packs, and combinations thereof.

In one non-limiting embodiment, an ADW detergent composition may be provided as a unit dose (e.g. capsules, tablets, and/or pouches) to provide the consumer one or more of the following benefits: a proper dosing means, dosing convenience, and specific treatments (i.e. improved dishware cleaning, tarnish protection for flatware, shine improvement, anti-corrosion protection, and/or tomato stain removal for plastic ware). In certain other non-limiting embodiments, the unit dose may provide a means to reduce negative interactions of incompatible components during the wash and/or rinse processes by allowing for the controlled release (e.g. delayed, sustained, triggered, slow release, etc.) of certain components of the ADW detergent composition. In certain non-limiting embodiments, a suitable unitized dose of the ADW detergent composition may, for example, contain: from about 15 g to about 60 g; from about 15 g to about 40 g; from about 15 g to about 25 g; and alternatively, from about 20 g to about 25 g of the ADW detergent composition.

A multi-compartment water-soluble pouch may comprise two or more incompatible components (e.g. bleach and enzymes) in separate compartments. The water-soluble pouch may be comprised of two or more water-soluble films defining two or more separate compartments. The two or more films may exhibit different dissolution rates in the wash liquor. One compartment may first dissolve and release a first component into the wash liquor up to 1 minute, up to 2 minutes, up to 3 minutes, up to 5 minutes, up to 8 minutes, up to 10 minutes, and alternatively up to 15 minutes faster in the wash liquor than the other compartment, which houses a second component that may be incompatible with the first component. In another non-limiting embodiment, a multi-phase ADW detergent product may comprise a solid (e.g. granules, capsules, and/or tablets) in one compartment, and in a separate compartment of a multi-compartment water-soluble pouch, a liquid and/or gel.

The ADW detergent composition may also be packaged in any suitable manner or form, for example, as part of a kit, which may comprise (a) a package; (b) an ADW detergent composition comprising (i) at least 8%, by weight, of a low-foaming nonionic surfactant with a cloud point of less than about 32° C., (ii) an effective amount of a polyvalent metal compound, and (iii) optionally, at least one adjunct ingredient; and (c) instructions for using the ADW detergent composition to treat dishware and reduce glassware surface corrosion.

Compositions of Matter

Any suitable compositions of matter may be used herein in any suitable aqueous solution. Suitable aqueous solutions include, but are not limited to: hot and/or cold water, wash and/or rinse liquor, and combinations thereof. For example, suitable compositions of matter may comprise wash liquor of an ADW appliance, which contains the ADW detergent composition provided herein in any suitable form, to treat and protect glassware from corrosion during automatic dishwashing.

One non-limiting embodiment may be directed to compositions of matter comprising wash liquor of an ADW appliance, which comprises from about 0.0001 ppm to about 100 ppm, or from about 0.001 ppm to about 50 ppm, or from about 0.01 ppm to about 30 ppm, and alternatively, from about 0.1 ppm to about 10 ppm of the polyvalent metal ion, by concentration.

Process of Manufacture

Any suitable conventional manufacturing process having any number of suitable process steps may be used to manufacture the ADW detergent composition, disclosed herein, in any suitable form as described herein.

For example, a solid ADW detergent composition may comprise a polyvalent metal compound composite which is separately formed before combined with the at least 8% nonionic surfactant and/or adjunct ingredient to reduce the likelihood of active segregation or the tendency of the polyvalent metal compound to settle or agglomerate in the ADW detergent composition and/or wash liquor.

The process of preparing the polyvalent metal compound composite includes the steps of: providing a suitable carrier material; heating the carrier material to above its melting point to form a solidified melt; providing an effective amount of a suitable polyvalent metal compound in powder form; and adding the polyvalent metal compound, alone or in combination with optional adjunct ingredients in powder form to the molten carrier medium in any order; dispersing polyvalent metal compound and/or optional adjunct ingredients into the molten carrier medium; cooling the molten mixture to form a composite solid; and shaping and/or grinding to a desired particle size and/or form (such as, a composite particle, prill, or flake). Alternatively, the molten mixture can be extruded to form a composite extrudate, then cooled, and ground to any suitable particle size.

Suitable particle sizes may range from about 10 micron to about 2000 microns. Alternatively, suitable particle sizes may range from about 100 microns to about 1500 microns, from about 200 microns to about 1200 microns, and from about 500 microns to about 1000 microns. The ground mixtures can then be dispersed into the ADW detergent composition to promote optimized corrosion protection performance.

Alternatively, a liquid ADW detergent composition may be prepared by directly mixing and/or dispersing an effective amount of polyvalent metal compound particles in water (and/or solvent) prior to the addition of the nonionic surfactant and optional adjunct ingredient(s).

The ADW detergent compositions described herein can also be suitably prepared and packaged by any suitable process chosen by the formulator, non-limiting examples of which may be described in U.S. Pat. No. 4,005,024 issued Jan. 25, 1977; U.S. Pat. No. 4,237,155 issued Dec. 2, 1980; U.S. Pat. No. 5,378,409 issued Jan. 3, 1995; U.S. Pat. No. 5,486,303 issued Jan. 23, 1996; U.S. Pat. No. 5,489,392 issued Feb. 6, 1996; U.S. Pat. No. 5,516,448 issued May 14, 1996; U.S. Pat. No. 5,565,422 issued Oct. 15, 1996; U.S. Pat. No. 5,569,645 issued Oct. 29, 1996; U.S. Pat. No. 5,574,005 issued Nov. 12, 1996; U.S. Pat. No. 5,599,400 issued Feb. 4, 1997; U.S. Pat. No. 5,599,786 issued Feb. 4, 1997; U.S. Pat. No. 5,691,297 issued Nov. 11, 1997; U.S. Pat. No. 5,698,505 issued Dec. 16, 1997; U.S. Pat. No. 5,703,034 issued Dec. 30, 1997; U.S. Pat. No. 5,768,918 issued Jun. 23, 1998; U.S. Pat. No. 5,891,836 issued Apr. 6, 1999; U.S. Pat. No. 5,952,278 issued Sep. 14, 1999; U.S. Pat. No. 5,952,278 issued Sep. 14, 1999; U.S. Pat. No. 5,968,539 issued Oct. 19, 1999; U.S. Pat. No. 5,990,065 issued Nov. 23, 1999; U.S. Pat. No. 6,069,122 issued May 30, 2000; U.S. Pat. No. 6,147,037 issued Nov. 14, 2000; U.S. Pat. No. 6,156,710 issued Dec. 5, 2000; U.S. Pat. No. 6,162,778 issued Dec. 19, 2000; U.S. Pat. No. 6,180,583 issued Jan. 30, 2001; U.S. Pat. No. 6,183,757 issued Feb. 6, 2001; U.S. Pat. No. 6,190,675 issued Feb. 20, 2001; U.S. Pat. No. 6,204,234 issued Mar. 20, 2001; U.S. Pat. No. 6,214,363 issued Apr. 10, 2001; U.S. Pat. No. 6,251,845 issued Jun. 26, 2001; U.S. Pat. No. 6,274,539 issued Aug. 14, 2001; U.S. Pat. No. 6,281,181 issued Aug. 28, 2001; U.S. Pat. No. 6,365,561 issued Apr. 2, 2002; U.S. Pat. No. 6,372,708 issued Apr. 16, 2002; U.S. Pat. No. 6,444,629 issued Sep. 3, 2002; U.S. Pat. No. 6,451,333 issued Sep. 17, 2002; U.S. Pat. No. 6,482,994 issued Nov. 19, 2002; U.S. Pat. No. 6,528,477 issued Mar. 4, 2003; U.S. Pat. No. 6,559,116 issued May 6, 2003; U.S. Pat. No. 6,573,234 issued Jun. 3, 2003; U.S. Pat. No. 6,589,926 issued Jul. 8, 2003; U.S. Pat. No. 6,627,590 issued Sep. 30, 2003; U.S. Pat. No. 6,627,590 issued Sep. 30, 2003; U.S. Pat. No. 6,630,440 issued Oct. 7, 2003; U.S. Pat. No. 6,645,925 issued Nov. 11, 2003; and U.S. Pat. No. 6,656,900 issued Dec. 2, 2003; U.S. Pat. Appl. Nos. 20030228998 to Dupont published December 2003; U.S. 20010026792 to Farrell et al. published October 2001; 20010031714 to Gassenmeier et al. published October 2001; 20020004472 to Holderbaum et al. published January 2002; 20020004473 to Busch et al. published January 2002; 20020013232 to Kinoshita et al. published January 2002; 20020013242 to Baillely et al. published January 2002; 20020013243 to Brown published March 2002; 20020028756 to Carter et al. published March 2002; 20020033004 to Edwards et al. published March 2002; 20020045559 to Forth et al. published April 2002; 20020055449 to Porta et al. published May 2002; 20020094942 to Danneels et al. published July 2002; 20020119903 to Lant et al. published August 2002; 20020123443 to Bennie et al. published September 2002; 20020123444 to Fisher et al. published September 2002; 20020137648 to Sharma et al. published September 2002; 20020166779 to Etesse et al. published November 2002; 20020169092 to Catlin et al. published November 2002; 20020169095 to Forth et al. November 2002; and 20020198125 to Jones published December 2002.

Test Methods

Measuring Dishwasher Arm RPM Efficiency and Wash Suds Height

The equipment useful for these measurements are: a General Electric Model GE 9000 automatic dishwashing appliance equipped with clear plexiglass door, IBM computer data collection with Labview and Excel Software, proximity sensor (Newark Corp.—model 95F5203) using SCXI interface, and a plastic ruler.

The data is collected as follows. The proximity sensor is affixed to the bottom rack of the automatic dishwasher on a metal bracket. The sensor faces downward toward the rotating dishwasher arm on the bottom of the appliance (distance approximately 2 cm. from the rotating arm). Each pass of the rotating arm is measured by the proximity sensor and recorded. The pulses recorded by the computer are converted to rotations per minute (RPM) of the bottom arm by counting pulses over a 30 second interval. The rate of the arm rotation is directly proportional to the amount of suds in the appliance and in the dishwasher pump (i.e., the more suds produced, the slower the arm rotation).

The plastic ruler is clipped to the bottom rack of the dishwasher and extends to the floor of the appliance. At the end of the wash cycle, the height of the suds is measured using the plastic ruler (viewed through the clear door) and recorded as suds height.

The following procedure is followed to evaluate the ADW detergent compositions herein for suds production, as well as, for evaluating LFNI surfactant systems for utility in such systems. A separate evaluation of the LFNI surfactant and/or surfactant system is made using an ADW base formula, such as CASCADE® base powder in combination with the LFNI surfactants, which are added separately in glass vials to the automatic dishwashing appliance.)

First, the appliance is filled with water (adjust water for appropriate temperature and hardness) and proceeds through a rinse cycle. The RPM is monitored throughout the cycle (approximately 2 min.) without any ADW detergent product (or LFNI surfactants) being added (a quality control check to ensure the appliance is functioning properly). As the appliance begins to fill for the wash cycle, the water is again adjusted for temperature and hardness, and then the ADW detergent composition is added to the bottom of the appliance (in the case of separately evaluated surfactant systems, the ADW base is first added to the bottom of the appliance then the LFNI surfactants are added by placing the surfactant-containing glass vials inverted on the top rack of the appliance). The RPM is then monitored throughout the wash cycle. At the end of the wash cycle, the suds height is recorded using the plastic ruler. The appliance is again filled with water (adjust water for appropriate temperature and hardness) and runs through another rinse cycle. The RPM is monitored throughout this cycle.

An average RPM is calculated for the 1st rinse, main wash, and final rinse. The % RPM efficiency is then calculated by dividing the average RPM for the test surfactants into the average RPM for the control system (ADW base formulation without the LFNI surfactant system). The RPM efficiency and suds height measurements are used to dimension the overall suds profile of the surfactant system.

Glassware Surface Corrosion Protection

In each test, the substrate is washed for 50 cycles in a General Electric Model GE 9000 automatic dishwasher under the following washing conditions: 0 gpg water −130° F., regular wash cycle, with the heated dry cycle turned on. On the top rack of the GE 2000, the following substrates are placed: four (4) Libbey 53 non-heat treated 10 oz. Collins glasses; three (3) Libbey 8564SR Bristol Valley 8½ oz. White Wine Glasses; three (3) Libbey 139 13 oz. English Hi-Ball Glasses; three (3) Luminarc Metro 16 oz. Coolers or 12 oz. Beverage glasses (use one size only per test); one (1) Longchamp Cristal d'Arques 5¾ oz. wine glass; and one (1) Anchor Hocking Pooh (CZ84730B) 8 oz. juice glass (when there are 1 or more designs per box—use only one design per test). On the bottom rack of the GE 9000, the following substrates are placed: two (2) Libbey Sunray No. 15532 dinner plates 9¼ in.; and two (2) Gibson black stoneware dinner plates #3568DP (optional—if not used replace with 2 ballast dinner plates).

All the glasses and/or plates are visually graded for iridescence and/or etching after washing and drying using a 1-5 grading scale (outlined below). All the glasses and/or plates are also visually graded for evidence of etching using the same 1-5grading scale used in the iridescence test. The values of grading scale are as follows: "1" indicates very severe damage to the substrate; "2" indicates severe damage to the substrate; "3" indicates some damage to the substrate; "4" indicates very slight damage to the substrate; and "5" indicates no damage to the substrate.

EXAMPLES

The following examples of ADW detergent compositions are provided for purposes of showing certain embodiments, and as such are not intended to be limiting in any manner.

| | EXAMPLES | | | | |
|---|---|---|---|---|---|
| Ingredients | 1 | 2 | 3 | 4 | 5 |
| STPP/SKTP/KTPP | 33.0 | 33.0 | 33.0 | 33.4 | 30.7 |
| Sodium citrate | — | — | — | — | 33.6 |
| Hydrozincite | 0.1 | 0.1 | 0.1 | 0.1 | 0.1 |

-continued

| Ingredients | EXAMPLES 1 | 2 | 3 | 4 | 5 |
|---|---|---|---|---|---|
| Sodium carbonate | 19.0 | 19.0 | 28.0 | 26.0 | — |
| Sodium silicate | 7.8 | 7.8 | 4.2 | 4.3 | — |
| LFNI surfactant[1] | 8 | 10 | 8 | 8 | 10 |
| Dispersant polymer | — | — | 4.3 | — | — |
| Sodium hypochlorite | — | — | — | 1.1 | — |
| Sodium perborate | 12.8 | 12.8 | 9.3 | — | — |
| Catalyst/activator[2] | 0.013 | 0.013 | 0.013 | — | — |
| Protease enzyme | 2.2 | 2.2 | 0.3 | — | 1.3 |
| Amylase enzyme | 1.7 | 1.7 | 0.9 | — | 0.2 |
| Aesthetic enhancing agents/Fillers/Water | Balance | Balance | Balance | Balance | Balance |

[1]POLY-TERGENT ® SLF-18B by Olin Corporation

[2]Pentamine acetate cobalt (III)/sodium nonanoyloxybenzene sulfonate

With reference to the polymers described herein, the term weight-average molecular weight is the weight-average molecular weight as determined using gel permeation chromatography according to the protocol found in Colloids and Surfaces, Physico Chemical & Engineering Aspects, Vol. 162, 2000, pg. 107-121. The units are Daltons.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing detergent unit dose composition comprising:

a) a combination comprising from about 0.1 to about 5% by weight of a polyvalent metal compound wherein the polyvalent metal compound is hydrozincite and b) at least 8% by weight of a low foaming, nonionic surfactant having a cloud point less than about 32° C.; wherein said combination exhibits improved glassware corrosion protection over at least 50 cycles in an automatic dishwasher; and c) a bleaching system, wherein the automatic dishwashing detergent composition is contained in a multi-compartment water soluble pouch.

2. The composition according to claim 1 wherein said polyvalent metal compound comprises particles having an average particle size range of from about 1 nm to about 150 microns.

3. The composition according to claim 2 wherein said polyvalent metal compound comprises particles having a particle size distribution within the range of from about 0.1 nm to about 250 microns.

4. The composition according to claim 1 wherein said polyvalent metal compound is in at least one of the following forms: a composite particle, a flake, a prill, and an extrudate.

5. The composition according to claim 1 wherein said low-foaming, nonionic surfactant has a cloud point of less than about 20° C.

6. The composition according to claim 1 wherein said low-foaming, nonionic surfactant has a hydrophile-lipophile balance value within the range of from about 1 to about 10.

7. The composition according to claim 1 further comprising a high cloud point nonionic surfactant having a cloud point of greater than about 40° C.

8. The composition according to claim 1 wherein said detergent composition further comprises an adjunct ingredient selected from the group consisting of: co-surfactants, suds suppressors, builders, sequestrants, enzymes, enzyme stabilizers, thickening agents, chelating agents, alkalinity sources, pH buffering agents, water softening agents, secondary solubility modifiers, soil release polymers, dispersant polymers, hydrotropes, fillers, binders, carrier mediums, oils, organic solvents, antibacterial actives, abrasives, anti-redeposition agents, anti-tarnish agents, anti-corrosion agents, processing aids, plasticizers, aesthetic enhancing agents, preservatives, and mixtures thereof.

9. The composition according to claim 8 wherein the builder is selected from the group consisting of citrates, phosphates, aluminosilicates, silicates, polycarboxylates, fatty acids, metal ion sequestrants, and mixtures thereof.

10. The composition according to claim 1 wherein the bleaching system comprises bleaching agents, bleach activators and/or bleach catalysts.

11. A kit comprising a package comprising: (a) the composition according to claim 1, and (b) instructions for use of said composition to treat dishware and reduce glassware surface corrosion.

* * * * *